US007301499B2

(12) United States Patent
Shin et al.

(10) Patent No.: US 7,301,499 B2
(45) Date of Patent: Nov. 27, 2007

(54) BUILT-IN TYPE ANTENNA APPARATUS FOR PORTABLE TERMINAL

(75) Inventors: Yong-Joo Shin, Yongin-si (KR); Alexander Goudelev, Suwon-si (KR); Wan-Jin Choi, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 36 days.

(21) Appl. No.: 11/231,121

(22) Filed: Sep. 20, 2005

(65) Prior Publication Data

US 2006/0244664 A1 Nov. 2, 2006

(30) Foreign Application Priority Data

Apr. 27, 2005 (KR) ..... 10-2005-0035070

(51) Int. Cl.
*H01Q 1/38* (2006.01)
*H01Q 1/24* (2006.01)
*H01Q 13/10* (2006.01)

(52) U.S. Cl. ..... 343/700 MS; 343/702; 343/767

(58) Field of Classification Search ..... 343/700 MS, 343/702, 767, 846
See application file for complete search history.

(56) References Cited

U.S. PATENT DOCUMENTS 6,552,686 B2 * 4/2003 Ollikainen et al. .. 343/700 MS
6,856,819 B2 * 2/2005 Itoh ..... 455/575.7
2002/0021248 A1 2/2002 Ying et al. ..... 343/700 MS

FOREIGN PATENT DOCUMENTS

| | | |
|---|---|---|
| DE | 102 04 079 | 8/2003 |
| EP | 0 942 488 | 9/1999 |
| EP | 1 113 524 | 7/2001 |
| EP | 1 387 433 | 2/2004 |
| WO | WO 01/33665 | 5/2001 |
| WO | WO 03/034544 | 4/2003 |

* cited by examiner

*Primary Examiner*—Shih-Chao Chen
(74) *Attorney, Agent, or Firm*—The Farrell Law Firm

(57) ABSTRACT

Disclosed is a built-in type antenna apparatus for a portable terminal which separates an antenna from a slot antenna and includes an additional sub-antenna. The built-in type antenna apparatus includes a first planar antenna having a shorting point and a feeding point; a second planar antenna provided at a position adjacent to the first planar antenna, the second planar antenna having a shorting point and providing at least one slot; and a sub-antenna electrically connected to the first planar antenna and electromagnetically coupled with the second planar antenna.

8 Claims, 8 Drawing Sheets

BUILT-IN TYPE ANTENNA APPARATUS FOR PORTABLE TERMINAL

PRIORITY

This application claims priority to an application entitled "BUILT-IN TYPE ANTENNA APPARATUS FOR PORTABLE TERMINAL" filed in the Korean Industrial Property Office on Apr. 27, 2005 and assigned Ser. No. 2005-35070, the contents of which are incorporated herein by reference.

BACKGROUND OF THE INVENTION

1. Field of the Invention

The present invention relates to a built-in type antenna apparatus for a portable terminal, and more particularly to a built-in type antenna apparatus for a portable terminal which separates an antenna from a slot antenna and includes an additional sub-antenna.

2. Description of the Related Art

Generally, portable communication devices refer to small and mobile devices by which radio communication can be performed. The Portable communication devices include a hand held phone (HHP), CT-2 cellular phone, a digital phone, a Personal communication system (PCS) phone, and a Personal digital assistant (PDA), and are classified according to their shapes. For example, the terminals are classified into a bar type, a flip type, a folding type, and a sliding type according to their shapes. The above-mentioned portable terminals inevitably include an antenna apparatus, a data input and output device, and a data transceiver. The data output device is generally an LCD.

Basically, a plurality of keys are arranged on a key pad used for data input. The keys include a send (SND) key which is a communication start button, a cancel key, a clear key (CLR), number keys, letter keys, an end (END) key, function keys, a power (PWR) key, etc.

Recently, the number of subscribers of the portable terminals has dramatically increased, and the portable terminals are so generalized that almost everyone carries a portable terminal. Although the portable terminals simply provided voice services at the beginning, portable terminals providing an AM/FM radio, MP3, moving image display, remote control, and other functions are now on the market.

Further, portable terminals providing a camera function and a high speed data communication function as well as a voice communication function have been developed. This means that many devices for satisfying various desires of consumers are installed in the portable terminals, and space for built-in antennas become smaller as the mounting areas of the other parts become larger.

The antennas are usually whip or helical antennas. The helical antenna is generally used to lower the mounting height of the antenna. Different from a rod antenna in which a rod is drawn to extend the length of the antenna, the helical antenna has a protruding portion on one side of the upper portion of the body of the terminal and is detachably fixed to the terminal. However, a terminal having a helical antenna does not have a good appearance due to the protruding portion of the antenna.

Built-in type antennas have become widely used in the terminals to resolve the above-mentioned disadvantage. A chip antenna, a planar inverted F antenna (PIFA), and a built in micro-strip patch antenna are mainly used as the built-in type antenna.

As shown in FIGS. 1 to 3, according to a built-in type antenna 3, a dielectric body and a conductive body (not shown) are installed at the upper end portion of a printed circuit board (PCB) 2 provided in a terminal 1, separated by an antenna installing portion 4. Transmission and reception of waves are satisfactorily performed only if the installing portion 4 provides the printed circuit board 2 with a predetermined height. Therefore, the built-in type antenna 3 is designed such that it is separated from the printed circuit board 2 by a predetermined height.

However, the conventional built-in type antenna has been mainly used in folding type and sliding type terminals. Since the folding type or sliding type terminal has a structure in which cases of the terminal are closed in a state in which they face each other, the antenna mounted into the body of the terminal performs the functions of a built-in type antenna in a state in which the terminal is opened, but the built-in antenna may be screened due to metal parts (e.g. a metal cover of an LCD and other metal parts) provided in the terminal before the terminal is opened. Then, the terminal is in a reception waiting state which shows a low reception rate. Further, as the thickness of the terminal becomes reduced, the mounting space of the built-in type antenna is also reduced and therefore the height of the antenna is lowered and an additional efficiency drop is generated. Therefore, an inclination property and a gain of the built-in type antenna are not sufficiently secured. Further, it becomes difficult to secure the performance and the radiation efficiency of the terminal.

SUMMARY OF THE INVENTION

Accordingly, the present invention has been made to solve the above-mentioned problems occurring in the prior art, and an object of the present invention is to provide a built-in antenna apparatus for a portable terminal which separates an antenna from a slot antenna and providing at least one slot, thereby improving the efficiency of the antenna apparatus.

It is another object of the present invention is to provide a built-in antenna apparatus for a portable terminal which provides a sub-antenna electrically connected to a slot antenna, thereby constantly maintaining the reception rate of the antenna apparatus regardless of the opening/closing operation of a case of the terminal.

It is still another object of the present invention to provide a built-in antenna apparatus for a portable terminal which provides a plurality of antennas on the front and rear sides of the portable terminal, thereby preventing a drop in the reception rate when a case of the terminal is closed.

In order to accomplish the above objects of the present invention, a built-in type antenna apparatus for a portable terminal includes a first planar antenna having a shorting point and a feeding point; a second planar antenna provided at a position adjacent to the first planar antenna, the second planar antenna having a shorting point and providing at least one slot; and a sub-antenna electrically connected to the first planar antenna and electromagnetically coupled with the second planar antenna.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, a preferred embodiment of the present invention will be described with reference to the accompanying drawings.

Figure 1:
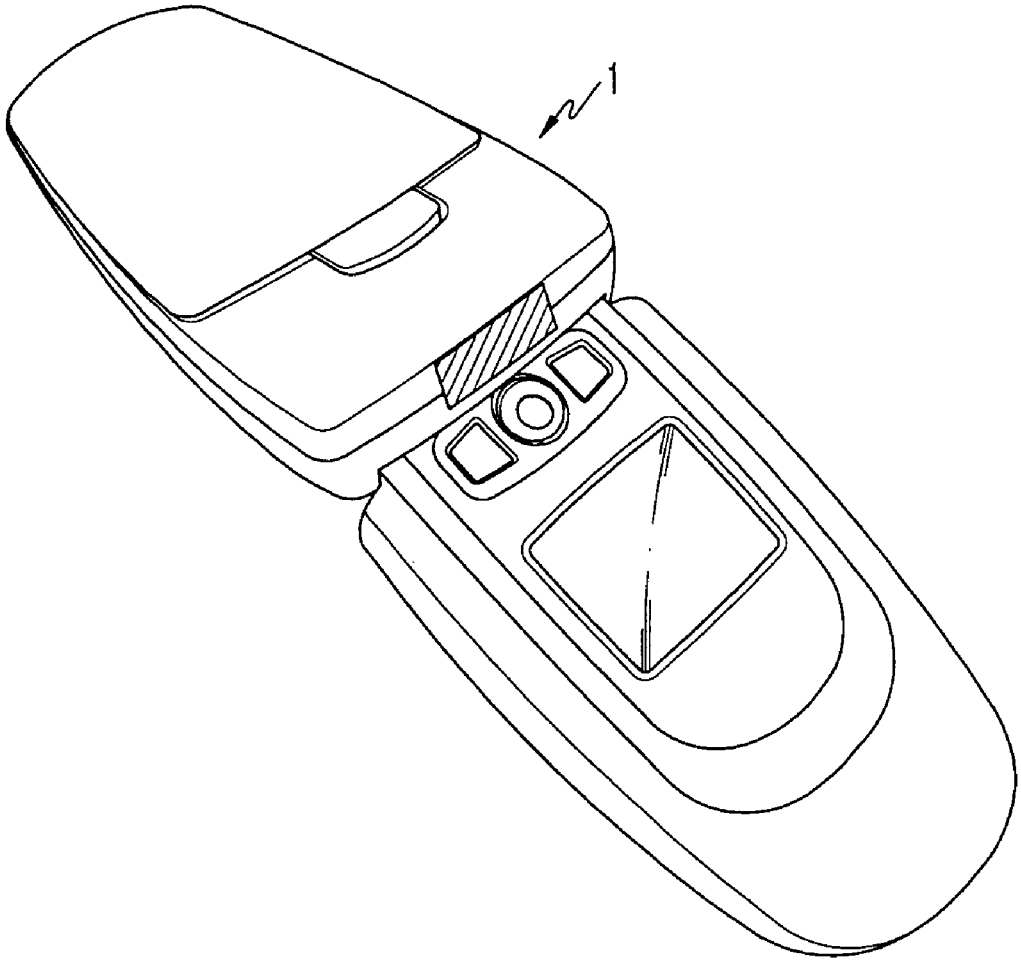
FIG. 1 PRIOR ART
FIG. 1 is a perspective view for showing a folding type terminal having a conventional built-in type antenna.
Figure 2:
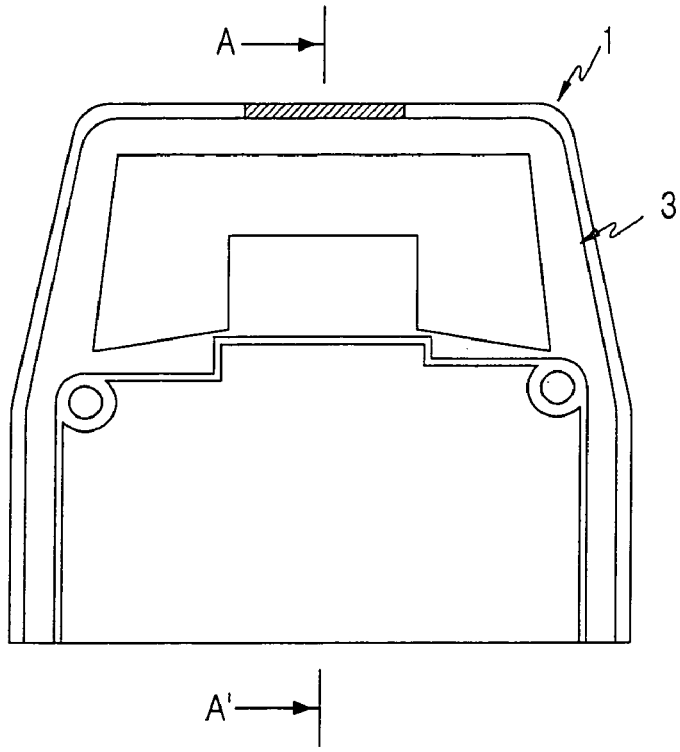
FIG.2 PRIOR ART
FIG. 2 is a plan view for showing the interior of FIG. 1.
Figure 3:
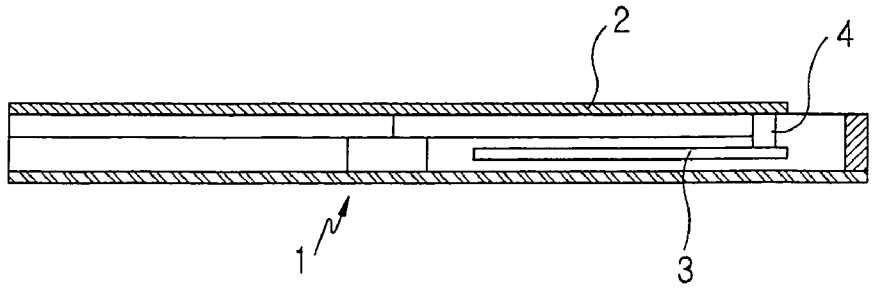
FIG.3 PRIOR ART
FIG. 3 is a cross-sectional view taken along line A-A'.
Figure 4:
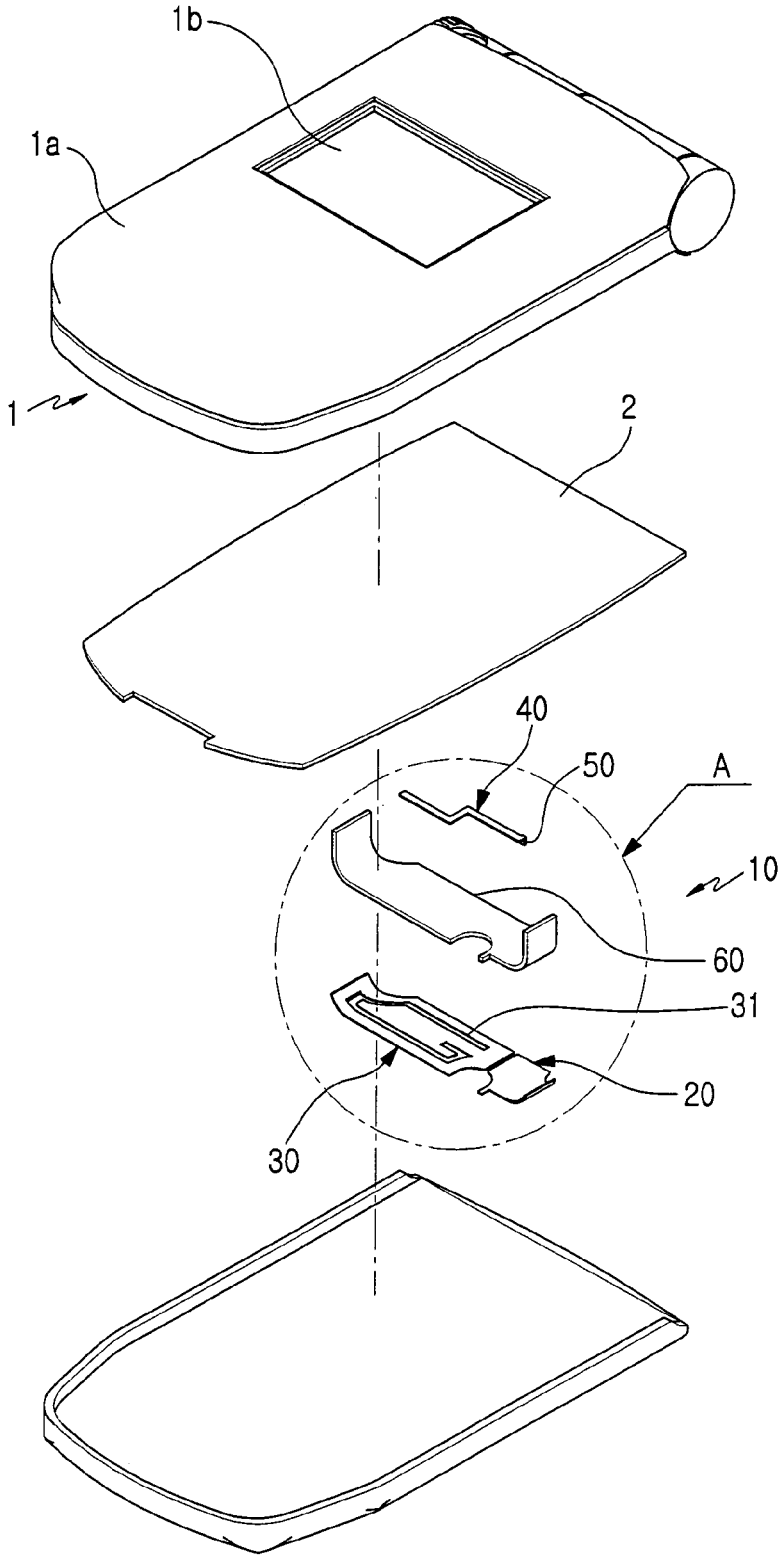
FIG. 4 is an exploded perspective view showing a built-in type antenna apparatus of a portable terminal according to a preferred embodiment of the present invention.
Figure 5:
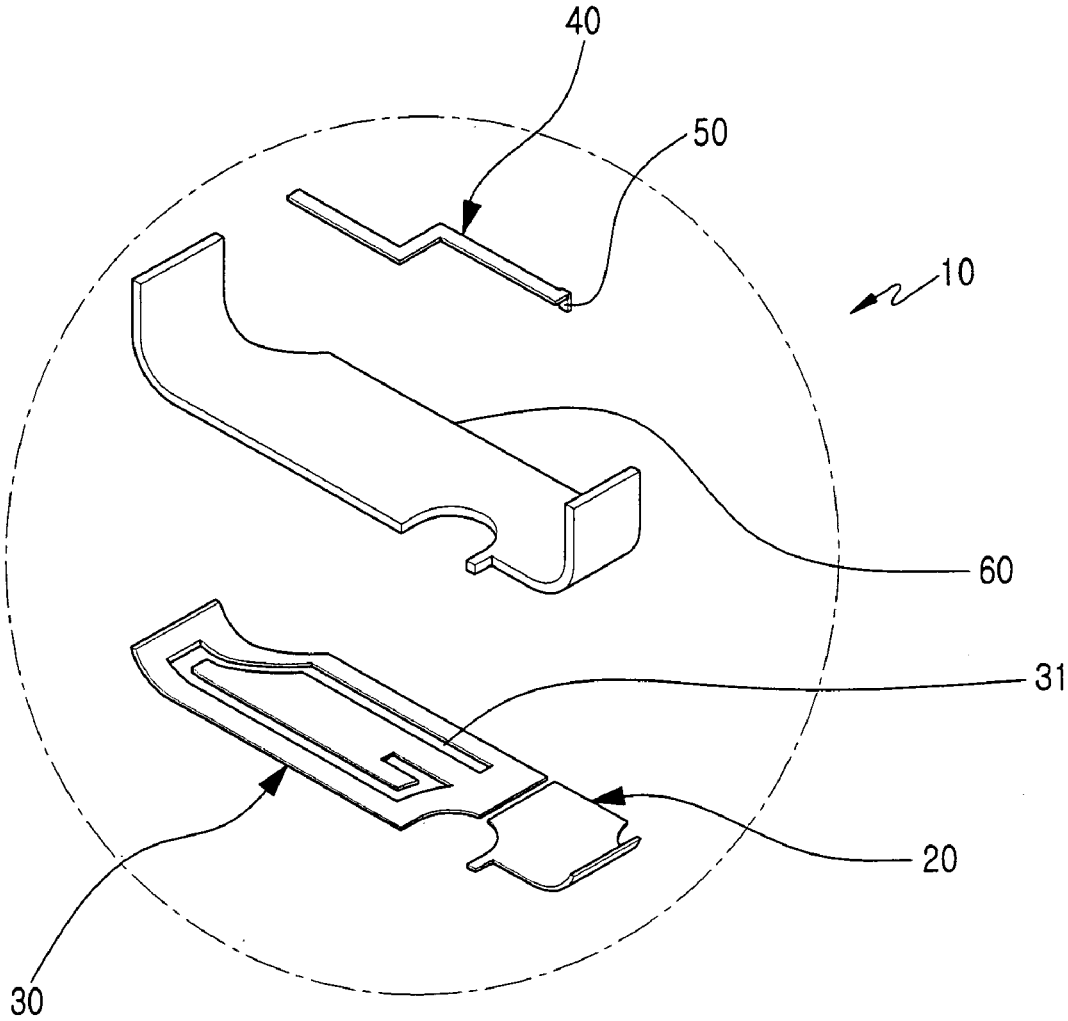
FIG. 5 is an exploded perspective view showing portion A of FIG. 4.
Figure 6:
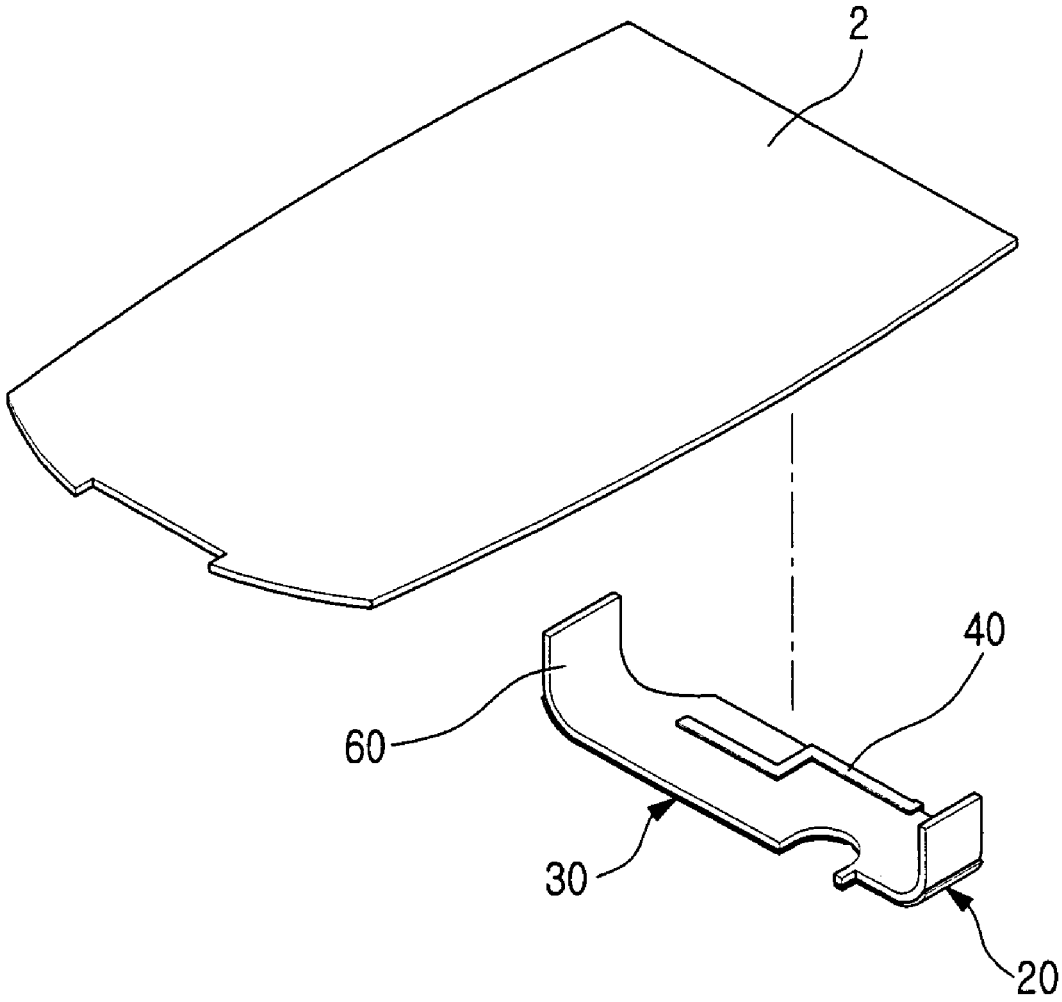
FIG. 6 is an exploded perspective view showing an engaged state of a built-in type antenna apparatus of a portable terminal according to a preferred embodiment of the present invention.

As shown in FIGS. 4 and 5, a built-in type antenna apparatus of a portable terminal includes first and second planar antennas 20 and 30, a sub-antenna 40, and a connecting means 50. The first planar antenna 20 includes a shorting point 21 and a feeding point 22 (see FIG. 7) so as to be electrically connected to a printed circuit board 2 provided in the terminal 1. The second planar antenna 30 also includes a shorting point 32. The second planar antenna 30 is connected to a ground of the terminal by the shorting point 21. At least one slot 31 is formed in the second planar antenna 30 and is provided at a position adjacent to the first planar antenna 20. The sub-antenna 40 is electrically connected to the first planar antenna 20 so as to be electromagnetically coupled with the second planar antenna 30. The connecting means 50 are provided in the sub-antenna 40 so as to be electrically connected to the first planar antenna 20.

Further, as shown in FIGS. 8 to 11, an antenna support member 60 is provided at a predetermined position of the printed circuit board 2 of the terminal 1 to attach the antennas 20, 30, and 40 and support the antennas 20, 30, and 40 so that the antennas 20, 30, and 40 are separated from the printed circuit board 2 by a predetermined height.

Figure 8:
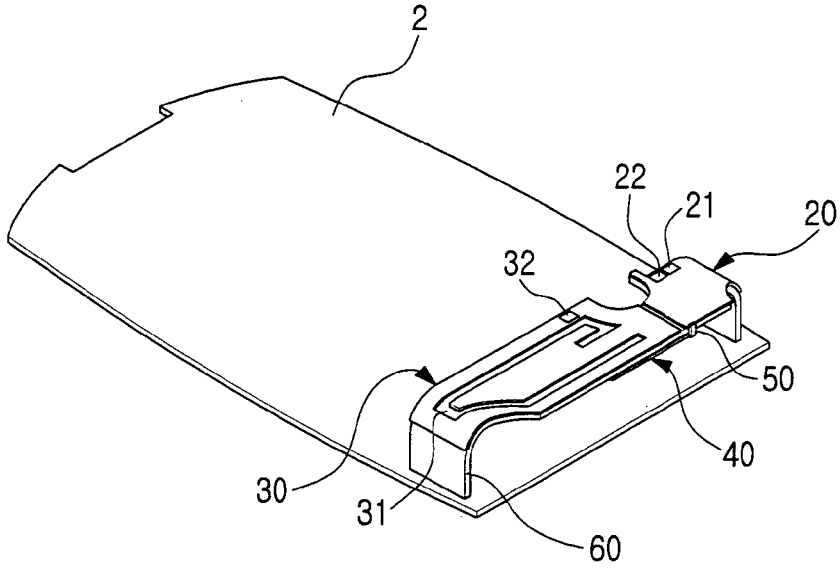
FIG. 8 is a perspective view showing a state in which a built-in type antenna apparatus of a portable terminal according to a preferred embodiment of the present invention is mounted to a printed circuit board.
Figure 9:
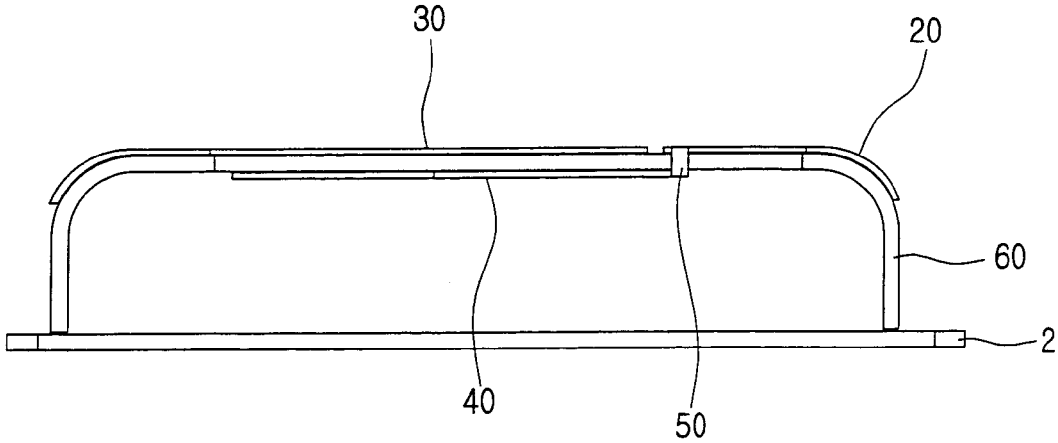
FIG. 9 is a front view showing a state in which a built-in type antenna apparatus of a portable terminal according to a preferred embodiment of the present invention is mounted to a printed circuit board.

As shown in FIGS. 8 and 9, the first and second planar antennas 20 and 30 are installed on the lower end surface of the antenna support member 60 side by side to provide a radiation pattern (not shown) on the rear surface of the terminal 1, thereby obtaining an inclination property and a gain and securing the performance of the antenna. The sub-antenna 40 is installed on the upper end surface of the antenna support member 60 to provide a radiation pattern (not shown) on the front surface of the terminal 1, thereby obtaining an inclination property and a gain regardless of the opening and closing operations of the terminal and securing more performance of the antenna.

As shown in FIG. 5, the slot 31 of the second planar antenna 30 is provided according to the shape and the length of the second planar antenna 30.

As shown in FIGS. 8 and 9, the sub-antenna 40 is provided according to the shape and the length of the slot 31 and is located at a two thirds point of the lengths of the planar antennas 20 and 30.

Figure 7:
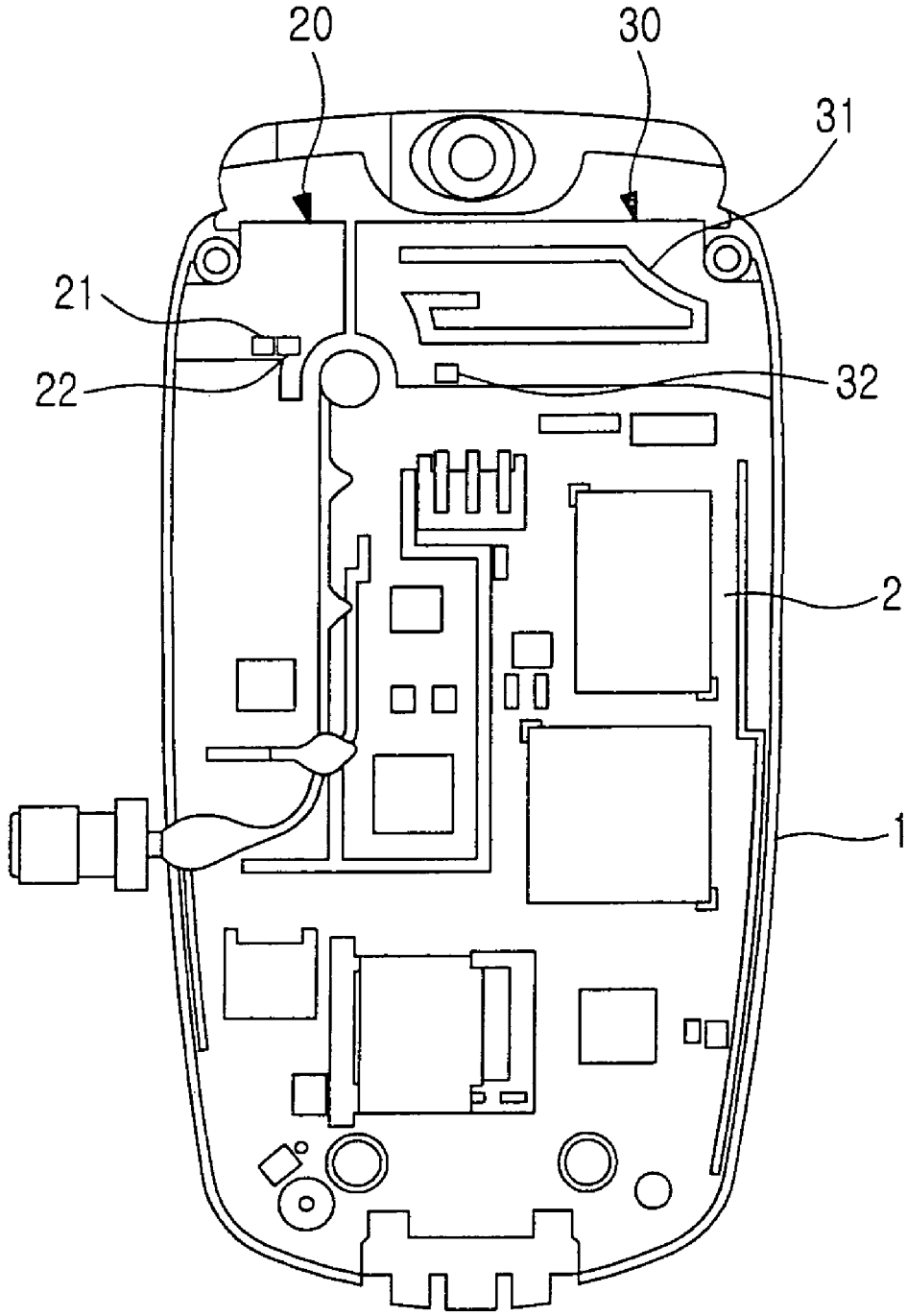
FIG. 7 is a bottom view showing a rear surface of a built-in type antenna apparatus of a portable terminal according to a preferred embodiment of the present invention.

As shown in FIGS. 7 and 8, the feeding point 22 is electrically connected to the terminal 1 to supply the current of the terminal to radiation bodies of the antennas 20, 30, and 40, and the shorting points 21 and 32 are connected to a ground provided on the printed circuit board 2. The magnetic current generated by the electric power inputted to the feeding point 22 flows to the radiation body of the first planar antenna 20.

Hereinafter, the operation of the built-in antenna apparatus for the portable terminal according to the present invention will be explained in detail with reference to FIGS. 4 to 11.

As shown in FIGS. 4 and 5, the slot antenna apparatus 10 of the portable terminal 1 includes the first planar antenna 20 having a shorting point 21 and feeding point 22, the second planar antenna 30 located at a position adjacent to the first planar antenna 20 and having at least one slot 31, and a sub-antenna 40 electrically connected to the first planar antenna 20.

Figure 10:
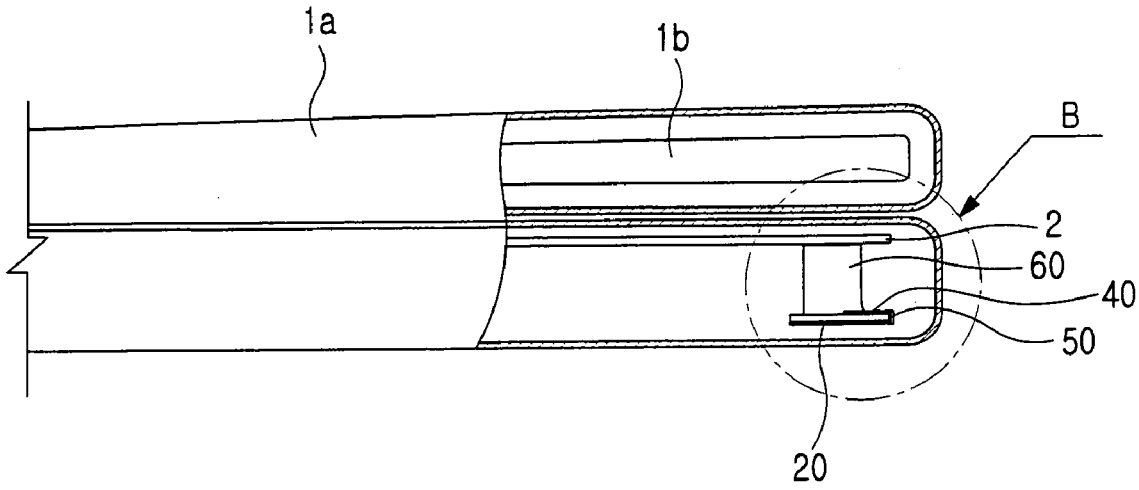
FIG. 10 is a partially cut-away side cross-sectional view of a built-in type antenna apparatus of a portable terminal according to a preferred embodiment of the present invention mounted to a printed circuit board.
Figure 11:
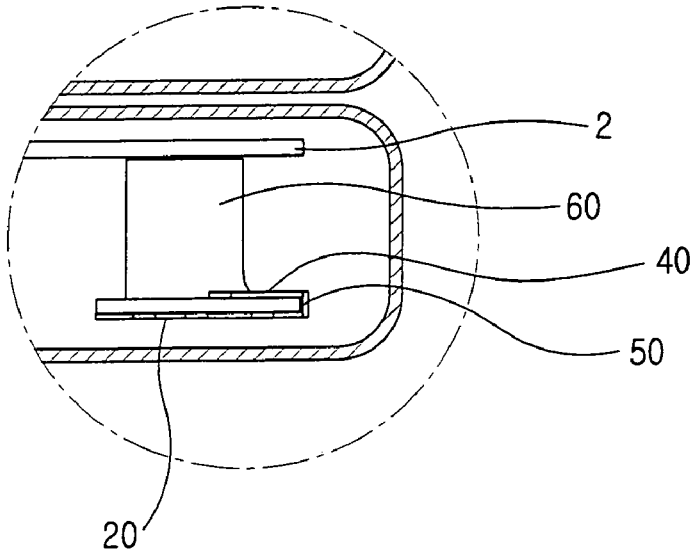
FIG. 11 is an exploded side cross-sectional view of portion B of FIG. 10.

Then, as shown in FIGS. 10 and 11, the first and second planar antennas 20 and 30 are mounted to the lower surface of the antenna support member 60 installed at a predetermined position of the printed circuit board 2 of the terminal 1 and the sub-antenna 40 is mounted to the upper surface of the antenna support member 60.

Then, as shown in FIGS. 8 and 9, the sub-antenna 40 is electrically connected to the first planar antenna 20. In this state, as shown in FIG. 7, electric power is supplied to the first planar antenna 20 through the feeding point 22 of the first planar antenna 20. Shorting points 21 and 32 are connected to a ground (not shown) provided in the terminal. The first and second planar antennas 20 and 30 resonate basically at $\lambda g/4$ and are designed such that their radiation efficiencies are maximized.

As shown in FIG. 8, the length of the sub-antenna 40 is determined to be $\lambda g/2$ of the length of the slot 31 so as to resonate at the same frequency as those of the planar antennas 20 and 30.

As shown in FIGS. 10 and 11, the first and second planar antennas 20 and 30 and the sub-antenna 40 are provided on the upper and lower surfaces of the antenna support member 60, respectively, to secure the gain and the performance of the antenna apparatus.

As shown in FIG. 9, the sub-antenna 40 is installed at a two thirds point of the lengths of the antennas, which is a point where the impedances of the first and second planar antennas 20 and 30 are several tens of Ohms, so as to be electromagnetically coupled with the second planar antenna. The impedance at a middle portion of the slot 31 forms a resistance of several hundreds of Ohms and forms almost zero Ohms at both ending points of the slot 31. If the sub-antenna 40 is designed such that it is electromagnetically coupled with the second planar antenna 20 at a point where the impedance of the slot 31 forms a resistance of several tens of Ohms, in case of impedance match, radiation patterns (not shown) are formed in the first and second planar antennas 20 on the lower surface of the antenna support member 60 and a radiation pattern (not shown) is formed in the sub-antenna 40 on the upper surface of the antenna support member 60.

As shown in FIGS. 7 and 10, due to the characteristics of the antennas 20, 30, and 40, a metal cover (not shown) of a liquid crystal display (LCD) 1*b* mounted in the folder 1*a* is operated as a reflection plate and the efficiency is improved by 3 to 5 dB compared with the planar antenna 20 in a state in which the case of the terminal 1 is closed. The efficiency of the antenna apparatus can also be improved in a state in which the folder 1*a* and a sliding housing (not shown) of the folding and sliding type terminals 1 are closed.

The following Table 1 shows experimental results comparing the efficiencies of the antenna apparatus according to opening/closing operations of folder 1*a*.

TABLE 1

| | Measurement | Conventional Antenna | | Present Invention | |
|---|---|---|---|---|---|
| Condition | Item | CDMA | USPCS | CDMA | USPCS |
| Opened Terminal | Peak gain | −0.1 dBi | −0.1 dBi | −0.1 dBi | −0.5 dBi |
| | Average Gain | −4.0 dBi | −4.6 dBi | −4.1 dBi | −4.0 dBi |
| | Efficiency | 40% | 35% | 39% | 40% |
| Closed Terminal | Peak Gain | −7.0 dBi | −4.2 dBi | −3.0 dBi | −1.0 dBi |
| | Average Gain | −10.5 dBi | −9.5 dBi | −7.4 dBi | −6.0 dBi |
| | Efficiency | 9% | 11% | 18% | 26% |

As shown in Table 1, the common problem of the built-in type antenna terminals is the drop of receiving efficiency due to a metal cover of the liquid crystal display 1*b*. Generally, the built-in antenna 10 shows a difference of 2 to 3 dB in the state in which the folder 1*a* is opened, but the folding type terminal 1 shows an efficiency difference of 6 to 7 dB. Basically, in the case where the folder 1*a* of the terminal is closed, if the height of the antenna is lowered and the natural efficiency decreases by 1 to 2 dB, the efficiency of the antenna is lowered additionally by 3 to 5 dB. This phenomenon is fatally applied to the efficiency of the terminal 1.

In order to solve this problem, the present invention provides a sub-antenna to the planar antenna having the slot and thus the drop of reception rate of the antenna generated due to a metal cover of a liquid crystal display of the terminal is prevented and the efficiency of the antenna apparatus improves regardless of the opened/closed state of the folder of the terminal.

While the invention has been shown and described with reference to certain a preferred embodiment thereof, it will be understood by those skilled in the art that various changes in form and details may be made therein without departing from the spirit and scope of the invention as defined by the appended claims.

What is claimed is:

1. A built-in type antenna apparatus for a portable terminal, which comprises:

a first planar antenna having a shorting point and a feeding point;

a second planar antenna provided at a position adjacent to the first planar antenna, the second planar antenna having a shorting point, and having at least one slot;

a sub-antenna electrically connected to the first planar antenna and electromagnetically coupled with the second planar antenna; and an antenna support member for separating the sub-antenna positioned on a surface of the antenna support member and the second planar antenna positioned on an other surface of the antenna support member.

2. A built-in type antenna apparatus according to claim 1, further comprising:

a connecting means for electrically connecting the sub-antenna to the first planar antenna, wherein the connecting means traverses from one surface to another surface of the antenna support member.

3. A built-in type antenna apparatus according to claim 1, wherein the antenna support member is provided at a predetermined position of a printed circuit board of the terminal.

4. A built-in type antenna apparatus according to claim 3, wherein the first and second planar antennas are installed side by side on the surface of the antenna support member and the sub-antenna is installed on the other surface of the antenna support member to provide a separation of a predetermined height between the sub-antenna and the first and second antennas from the printed circuit board.

5. A built-in type antenna apparatus according to claim 1, wherein the slot of the second planar antenna is provided according to the shape and the length of the second planar antenna.

6. A built-in type antenna apparatus according to claim 1, wherein the sub-antenna is constructed according to the shape and the length of the slot.

7. A built-in type antenna apparatus according to claim 1, wherein the feeding point is electrically connected to the terminal to supply current to radiation bodies of the antennas and the shorting points are connected to a ground provided on the printed circuit board.

8. A built-in type antenna apparatus for a portable terminal, which comprises:

a planar antenna;

a slot antenna provided at a position adjacent to the planar antenna, the slot antenna having at least one slot;

a sub-antenna electrically connected to the planar antenna and electromagnetically coupled with the slot antenna; and an antenna support member for attaching the antennas and separating the antennas, wherein the sub-antenna is positioned on one side of the antenna support member and the planar and slot antenna are positioned on an other side of the antenna support member.

* * * * *